US006611605B2

(12) United States Patent
Kim

(10) Patent No.: US 6,611,605 B2
(45) Date of Patent: Aug. 26, 2003

(54) SPEAKER HAVING A DEVICE CAPABLE OF GENERATING SOUND AND VIBRATION

(75) Inventor: Jeong Uk Kim, Yangsan (KR)

(73) Assignee: Estec Corporation, Kyungsangnam-do (KR)

( * ) Notice: Subject to any disclaimer, the term of this patent is extended or adjusted under 35 U.S.C. 154(b) by 0 days.

(21) Appl. No.: 09/728,966

(22) Filed: Dec. 4, 2000

(65) Prior Publication Data

US 2001/0017922 A1 Aug. 30, 2001

(51) Int. Cl.[7] ..... H04R 9/06
(52) U.S. Cl. ..... 381/406; 381/396; 381/401
(58) Field of Search ..... 381/150, 182, 381/186, 396, 400, 401, FOR 152, FOR 155, FOR 159, FOR 160, FOR 165, 406, 412, 421, 410; 340/7.6, 388.1, 388.2, 407.1

(56) References Cited

U.S. PATENT DOCUMENTS 4,495,638 A * 1/1985 Yamada et al. ..... 381/27
4,720,868 A * 1/1988 Hirano ..... 381/182
5,528,697 A 6/1996 Saito ..... 381/192
6,373,958 B1 * 4/2002 Enomoto et al. ..... 381/406
2001/0013729 A1 * 8/2001 Hamaguchi et al. ..... 310/81

FOREIGN PATENT DOCUMENTS

KR 2002/486972 12/2002 ..... H04R/1/24

* cited by examiner

*Primary Examiner*—Curtis Kuntz
*Assistant Examiner*—Brian Ensey
(74) *Attorney, Agent, or Firm*—Fulbright & Jaworski L.L.P.

(57) ABSTRACT

Disclosed is a speaker having a device capable of generating sound and vibration for notifying reception of an incoming call when a radio incoming signal is received. The speaker comprises a cylindrical frame; magnetic field forming means disposed in the cylindrical frame for forming first and second magnetic flux; a sound generating section for producing electromagnetic force by interaction with the first magnetic flux and thereby generating sound, when a signal having a frequency which is no less than a predetermined frequency, is applied thereto; and vibration generating means for producing electromagnetic force by interaction with the second magnetic flux and thereby generating vibration, when a signal having a frequency which is less than the predetermined frequency, is applied thereto.

3 Claims, 6 Drawing Sheets

SPEAKER HAVING A DEVICE CAPABLE OF GENERATING SOUND AND VIBRATION

BACKGROUND OF THE INVENTION

1. Field of the Invention

The present invention relates to a speaker provided in a communication terminal such as a portable phone, a beeper or the like, and more particularly, the present invention relates to a speaker which has a single device capable of generating incoming call notifying sound and vibration and uses a magnetic field leaking from an outer part of a magnetic circuit section, in a manner such that sufficiently powerful sound and vibration are obtained.

2. Description of the Related Art

Generally, in a portable communication terminal such as a portable phone, a beeper or the like, if an incoming call from an outer source such as a base station is received therein, notification of reception of the incoming call is performed through sound or vibration. To this end, a conventional portable phone or beeper has a sound generating device and a vibration generating device which are separately provided to constitute means for notifying the reception of an incoming call. In this regard, in order to implement a sounding function, a micro speaker, a buzzer, and the like have been used, and, in order to implement a vibrating function, a vibrating motor having a rotation shaft to which an eccentric weight is attached, and the like have been used.

However, the conventional portable phone or beeper including the sound generating device and the vibration generating device which are separately provided, has a problem in that a number of parts is increased and thereby a volume of the portable phone or beeper is also increased, which run counter to miniaturization and lightweightness of the portable phone or beeper.

To cope with this problem, a portable phone or beeper having a speaker which employs a single device so as to generate both of sound and vibration, has been disclosed in the art. Referring to FIG. 1, there is shown an exploded perspective view illustrating a speaker having a single device capable of generating sound and vibration.

As can be readily seen from FIG. 1, a conventional speaker having a single device capable of generating sound and vibration, includes a sound generating section 20 and a magnetic circuit section 40 which is arranged below the sound generating section 20. The sound generating section 20 has a voice coil 24 and a vibrating plate 22 which is assembled to the voice coil 24 to be integrally vibrated therewith. An upper cover 10 covers an upper surface of the vibrating plate 22 to protect the vibrating plate 22. The voice coil 24 is secured to a lower end of the vibrating plate 22. Further, an upper leaf spring 30 is positioned below the vibrating plate 22 in such a way as to vibrate a frame 50. A terminal block 52 is attached to a portion of the frame 50 in a manner such that the terminal block 52 can connect the frame 50 and an external power supply with each other. The magnetic circuit section 40 which is disposed below the upper leaf spring 30, is composed of a plate 42, a magnet 44 and a yoke 46. The terminal block 52 which is attached to the portion of the frame 50, functions to support the magnetic circuit section 40 and transmit vibrating force generated in the magnetic circuit section 40 to the frame 50. Below the frame 50, there are sequentially disposed a lower leaf spring 30 which vibrates the frame 50 and a lower cover 60 which protects the inside of the speaker.

Hereinafter, operations of the conventional speaker constructed as mentioned above will be described. The conventional speaker largely performs a sound generating function and a vibration generating function. First, the sound generating function is performed in a manner described below. That is to say, due to electromagnetic force which is produced by interaction between a magnetic field developed in the magnetic circuit section 40 and an electric field developed in the voice coil 24, driving force is created in the voice coil 24. By the driving force, the voice coil 24 and the vibrating plate 22 which is integrally coupled to the voice coil 24, are driven upward and downward in unison. Therefore, through vibration of the vibrating plate 22, incoming call notifying sound is generated. At this time, a reproduction frequency band for the incoming call notifying sound is selected to be a radio frequency band which serves as an audible frequency band.

On the other hand, the vibration generating function is performed in a low frequency band. By electromagnetic force which is produced in the magnetic circuit section 40 and the voice coil 24, the magnetic circuit section 40 is vibrated upward and downward. This vibrating force is transmitted through the upper and lower leaf springs 30 which are brought into contact with the magnetic circuit section 40, to the frame 50.

However, the conventional speaker having the above-described construction, still suffers from defects in that, since the electromagnetic force which is produced by the interaction between the magnetic field developed in the magnetic circuit section 40 and the electric field developed in the voice coil 24, serves as driving force upon generating sound and upon generating vibration, the driving force is not so powerful that a desired level of driving force cannot be accomplished. In other words, a magnitude of the electric field which is developed only by the voice coil 24, cannot but be limited to a certain value. Also, due to the fact that magnetic flux leakage is induced in an outer part of the magnetic circuit section 40, it is difficult to procure powerful driving force in conformity with a desire of a user.

SUMMARY OF THE INVENTION

Accordingly, the present invention has been made in an effort to solve the problems occurring in the related art, and an object of the present invention is to provide a speaker which has a single device capable of generating sound and vibration when a radio incoming call is received in a communication terminal such as a portable phone, a beeper or the like, and uses a magnetic field leaking from an outer part of a magnetic circuit section, in a manner such that sufficiently powerful sound and vibration are obtained.

In order to achieve the above object, according to one aspect of the present invention, there is provided a speaker capable of generating sound and vibration for notifying reception of an incoming call when a radio incoming signal is received, the speaker comprising: a cylindrical frame; magnetic field forming means disposed in the cylindrical frame for forming first and second magnetic flux; a sound generating section for producing electromagnetic force by interaction with the first magnetic flux and thereby generating sound, when a signal having a frequency which is no less than a predetermined frequency, is applied thereto; and vibration generating means for producing electromagnetic force by interaction with the second magnetic flux and thereby generating vibration, when a signal having a frequency which is less than the predetermined frequency, is applied thereto.

Preferably, the magnetic field forming means includes an annular plate, an annular magnet and a yoke; the yoke has an annular flange portion, a cylindrical side wall portion which extends upward from a circumferential inner surface of the annular flange portion, and a top disc portion which closes an upper end of the cylindrical side wall portion; the annular magnet and the annular plate are sequentially stacked on the annular flange portion of the yoke in a manner such that the cylindrical side wall portion and the top disc portion of the yoke are inserted into openings which are defined at center portions of the annular magnet and plate and a gap is defined between circumferential inner surfaces of the annular magnet and plate and a circumferential outer surface of the cylindrical side wall portion of the yoke; and the first magnetic flux is formed in the gap and the second magnetic flux is formed outside the annular magnet and plate.

More preferably, the sound generating section includes a vibrating plate and a voice coil; the voice coil is integrally coupled to a lower end of the vibrating plate and is located in the gap; and, when the signal having the frequency which is no less than the predetermined frequency, is applied to the voice coil, the voice coil interacts with the first magnetic flux, and thereby vibrates the vibrating plate and generates sound.

The vibration generating means includes a vibrating coil which is located between a circumferential inner surface of the cylindrical frame and the annular magnet, and a leaf spring which is coupled at one end thereof to a lower surface of the annular flange portion of the yoke to elastically support the yoke and is secured at the other end thereof to the cylindrical frame; the vibrating coil is fixedly supported by the cylindrical frame; and, when the signal having the frequency which is less than the predetermined frequency, is applied to the vibrating coil, the vibrating coil interacts with the second magnetic flux and thereby vibrates the magnetic field forming means. At this time, the vibrating coil can be connected in parallel with the voice coil. Also, the vibrating coil can be connected in series with the voice coil.

BRIEF DESCRIPTION OF THE DRAWINGS

The above objects, other features and advantages of the present invention will become more apparent after a reading of the following detailed description when taken in conjunction with the drawings, in which.

DETAILED DESCRIPTION OF PREFERRED EMBODIMENTS

Figure 1:
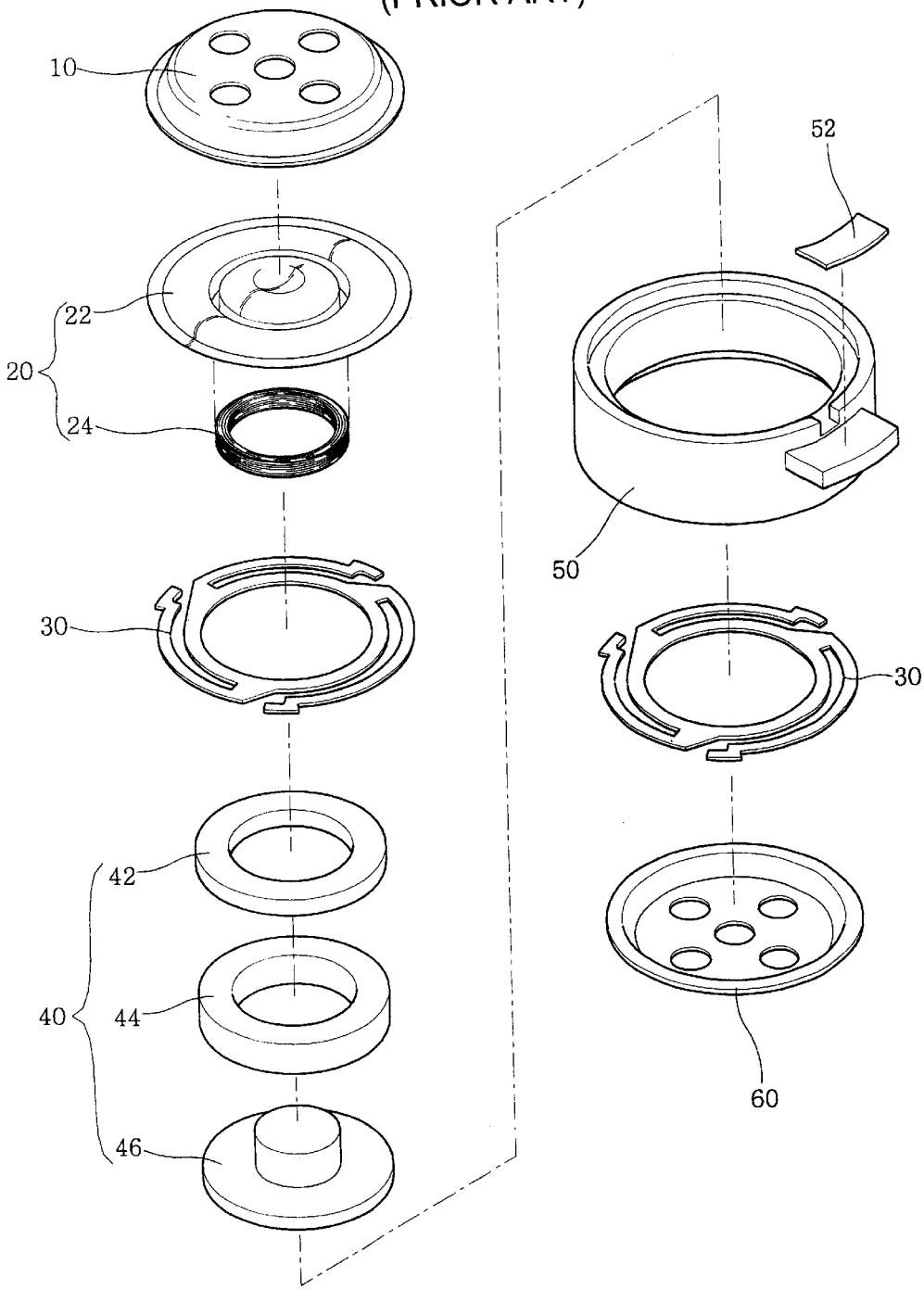
FIG. 1 (PRIOR ART)
FIG. 1 is an exploded perspective view illustrating a conventional speaker.
Figure 2:
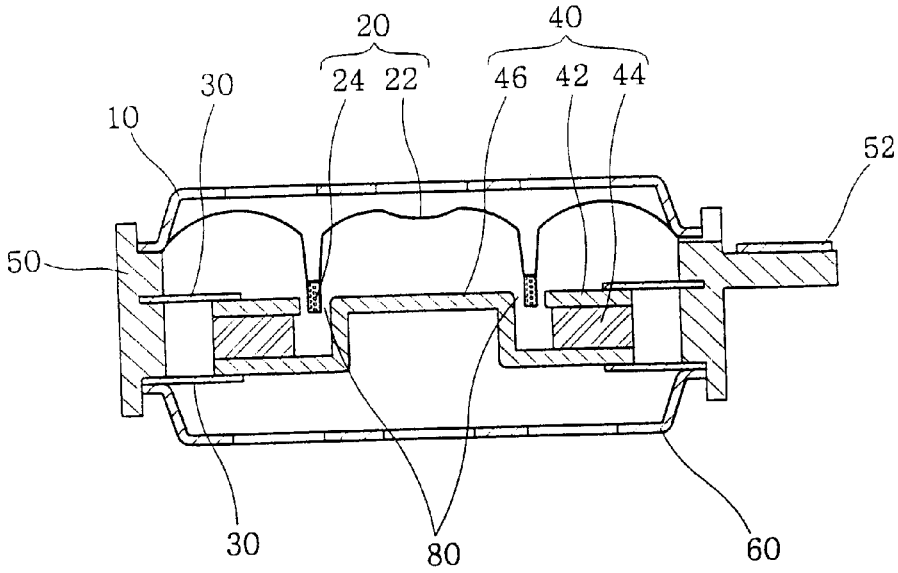
FIG. 2 (PRIOR ART)
FIG. 2 is a cross-sectional view illustrating the conventional speaker.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 3:
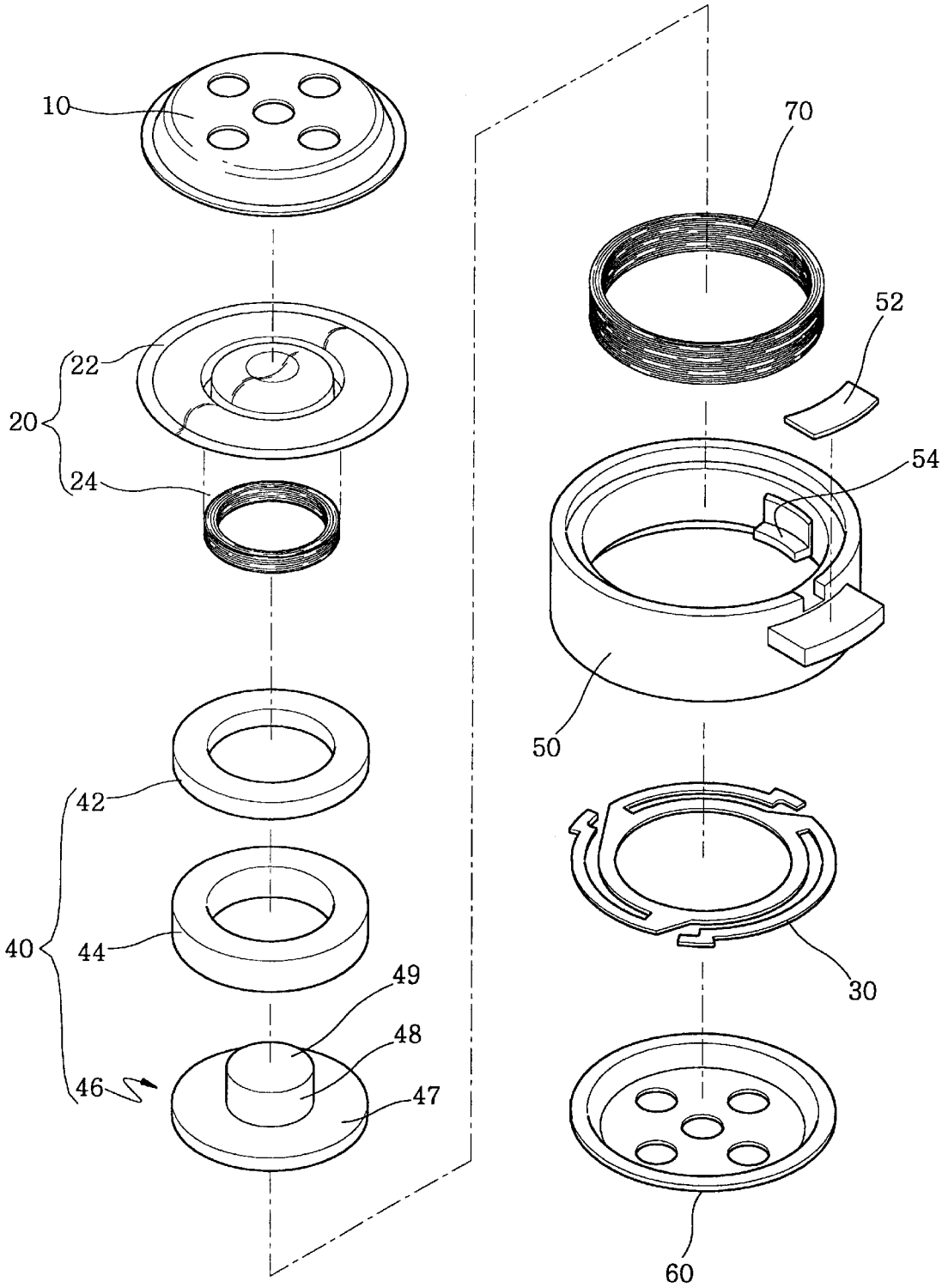
FIG. 3 is an exploded perspective view illustrating a speaker having a device capable of generating sound and vibration, in accordance with an embodiment of the present invention.
Figure 5:
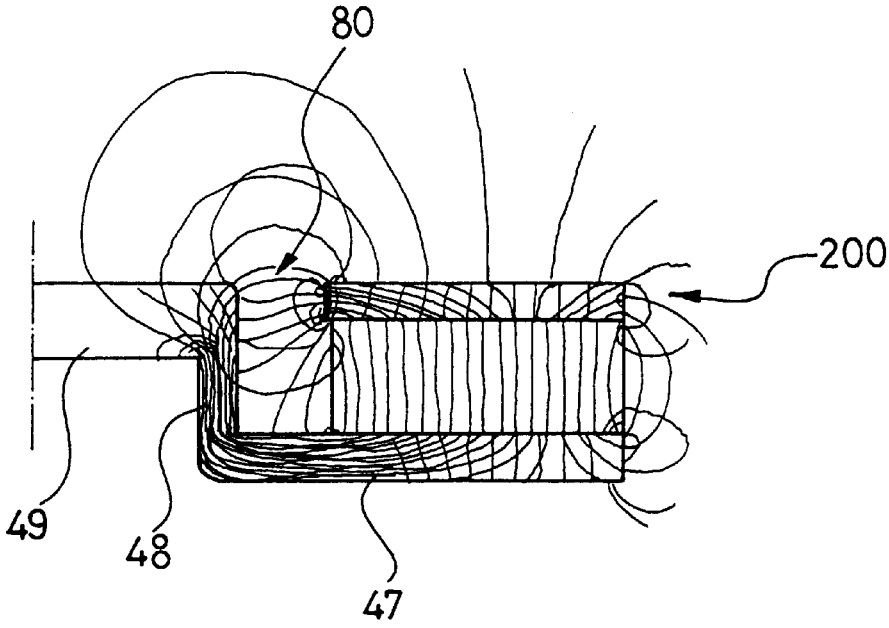
FIG. 5 is a schematic view illustrating magnetic flux distribution in a magnetic circuit section of the speaker shown in FIG. 3.

As shown in FIGS. 3 and 5, a speaker 100 having a device capable of generating sound and vibration, in accordance with an embodiment of the present invention, includes a cylindrical frame 50, a sound generating section 20 and a magnetic circuit section 40 which are disposed in the cylindrical frame 50, and an upper cover 10 and a lower cover 60 which respectively cover upper and lower ends of the cylindrical frame 50.

The magnetic circuit section 40 includes an annular plate 42, an annular magnet 44 and a yoke 46. The yoke 46 has an annular flange portion 47, a cylindrical side wall portion 48 which extends upward from a circumferential inner surface of the annular flange portion 47, and a top disc portion 49 which closes an upper end of the cylindrical side wall portion 48.

Figure 4:
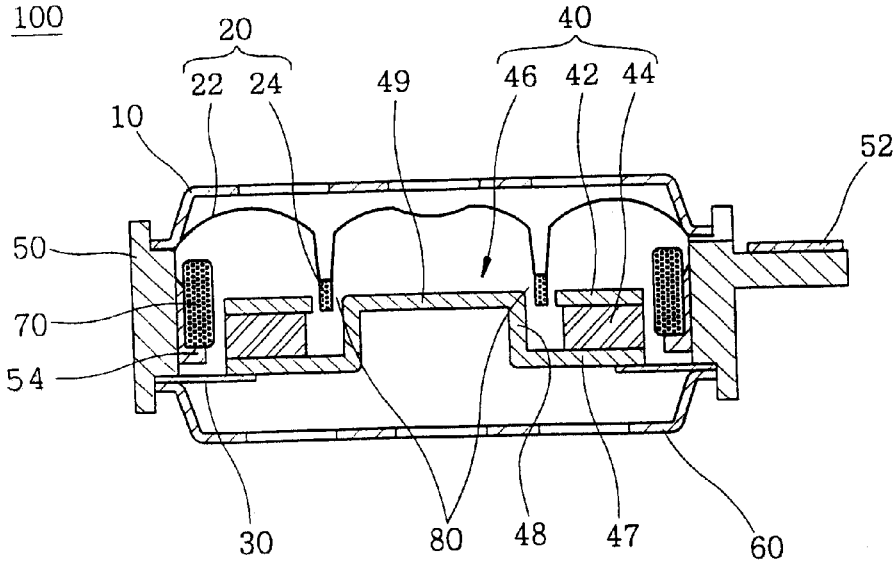
FIG. 4 is a cross-sectional view illustrating the speaker shown in FIG. 3.

The magnet 44 and plate 42 each having an annular configuration are sequentially stacked on the flange portion 47 also having an annular configuration, of the yoke 46. Thus, the cylindrical side wall portion 48 and the top disc portion 49 of the yoke 46 are inserted into openings which are defined at center portions of the annular magnet 44 and plate 42, and, as shown in FIG. 4, a gap 80 is defined between circumferential inner surfaces of the annular magnet 44 and plate 42 and a circumferential outer surface of the cylindrical side wall portion 48 of the yoke 46.

On the other hand, each of the yoke 46 and the annular plate 42 is made of a ferromagnetic material such as soft iron, and the annular magnet 44 comprises a permanent magnet made of a suitable material such as ferrite, neodymium, or the like. Consequently, as can be readily seen from FIG. 5, while a dense and powerful magnetic field is formed in the gap 80, leakage flux is distributed outside the magnetic circuit section 40, that is, outside the annular magnet 44. At this time, although the leakage flux has a density which is lower than flux distributed in the gap 80, a total amount of the leakage flux is substantial.

The sound generating section 20 includes a vibrating plate 22 and a voice coil 24, and is located above the magnetic circuit section 40. The voice coil 24 is coupled to a lower end of the vibrating plate 22. The voice coil 24 is installed in a manner such that it is located in the gap 80 of the magnetic circuit section 40. The vibrating plate 22 is vibrated depending upon a variation in an electric field, which is induced by a variation in a voltage applied to the voice coil 24, and thereby generates voice or sound. The sound generating section 20 has a smaller mass than the magnetic circuit section 40 so that it can reliably perform a sound generating function.

A vibrating coil 70 is located between a circumferential inner surface of the cylindrical frame 50 and the magnetic circuit section 40. The vibrating coil 70 is supported by a pair of supporting brackets 54 which are secured to the cylindrical frame 50, and interacts with the leakage flux distributed outside the magnetic circuit section 40 so as to produce electromagnetic force. The vibrating coil 70 can be connected in series or in parallel with the voice coil 24, and has a larger diameter than the voice coil 24.

The lower cover 60 is brought into close contact with a lower end of the cylindrical frame 50. A leaf spring 30 is interposed between the cylindrical frame 50 and the lower cover 60 and is securely maintained therebetween. The annular flange portion 47 of the yoke 46 which constitutes the magnetic circuit section 40, is bonded to an upper surface of the leaf spring 30, by which vibration of the magnetic circuit section 40 is transmitted to the leaf spring 30 as it is.

The upper cover 10 is brought into close contact with an upper end of the cylindrical frame 50. The vibrating plate 22 is interposed between the cylindrical frame 50 and the upper cover 10 and is securely maintained therebetween. Hence, the voice coil 24 which is coupled to the lower end of the vibrating plate 22 can be located in the gap 80.

The unexplained drawing reference numerals 52 and 200 represent a terminal block which is attached to a portion of the cylindrical frame 50 and the leakage flux distributed outside the magnetic circuit section 40, respectively.

Figure 6:
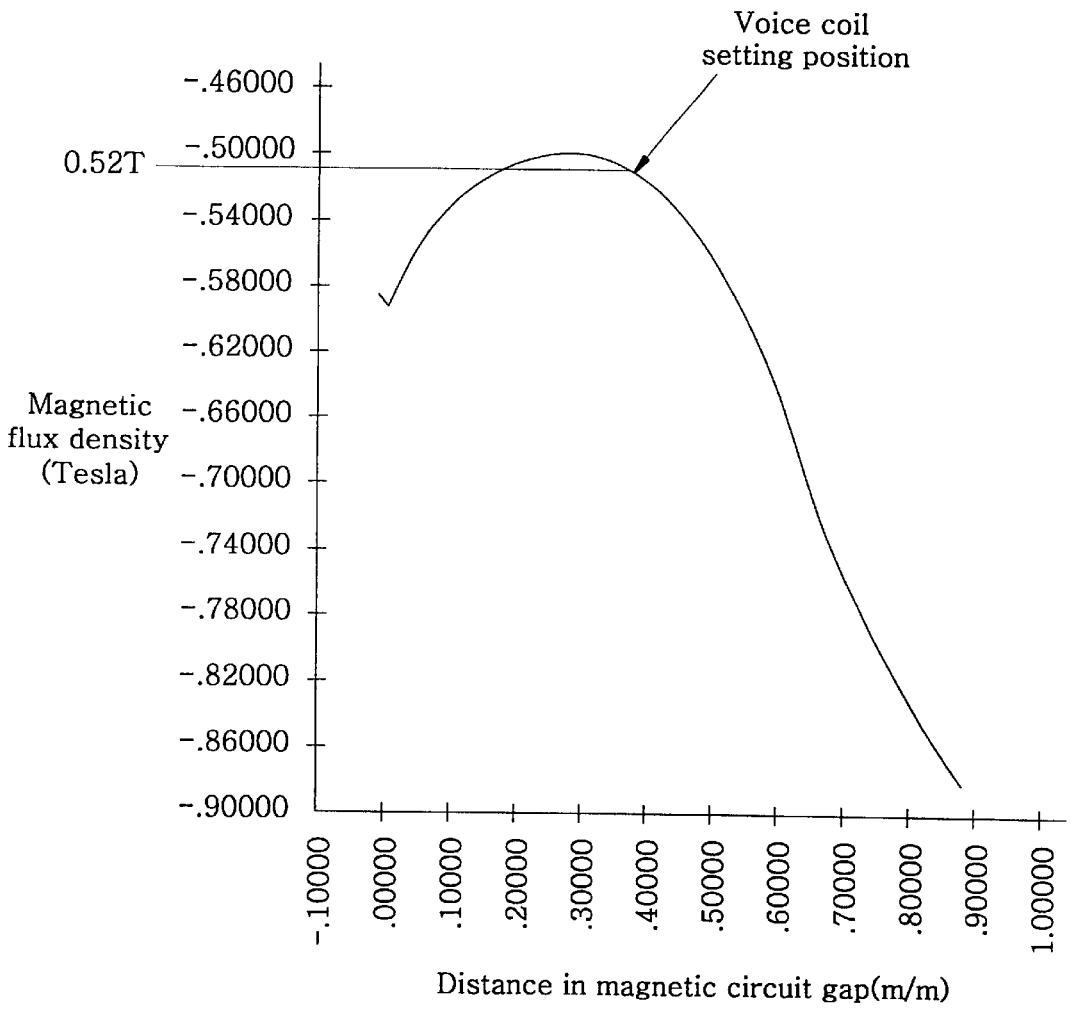
FIG. 6 is a graph illustrating a variation in magnetic flux density, depending upon an installation position of a voice coil in the speaker shown in FIG. 3.
Figure 7:
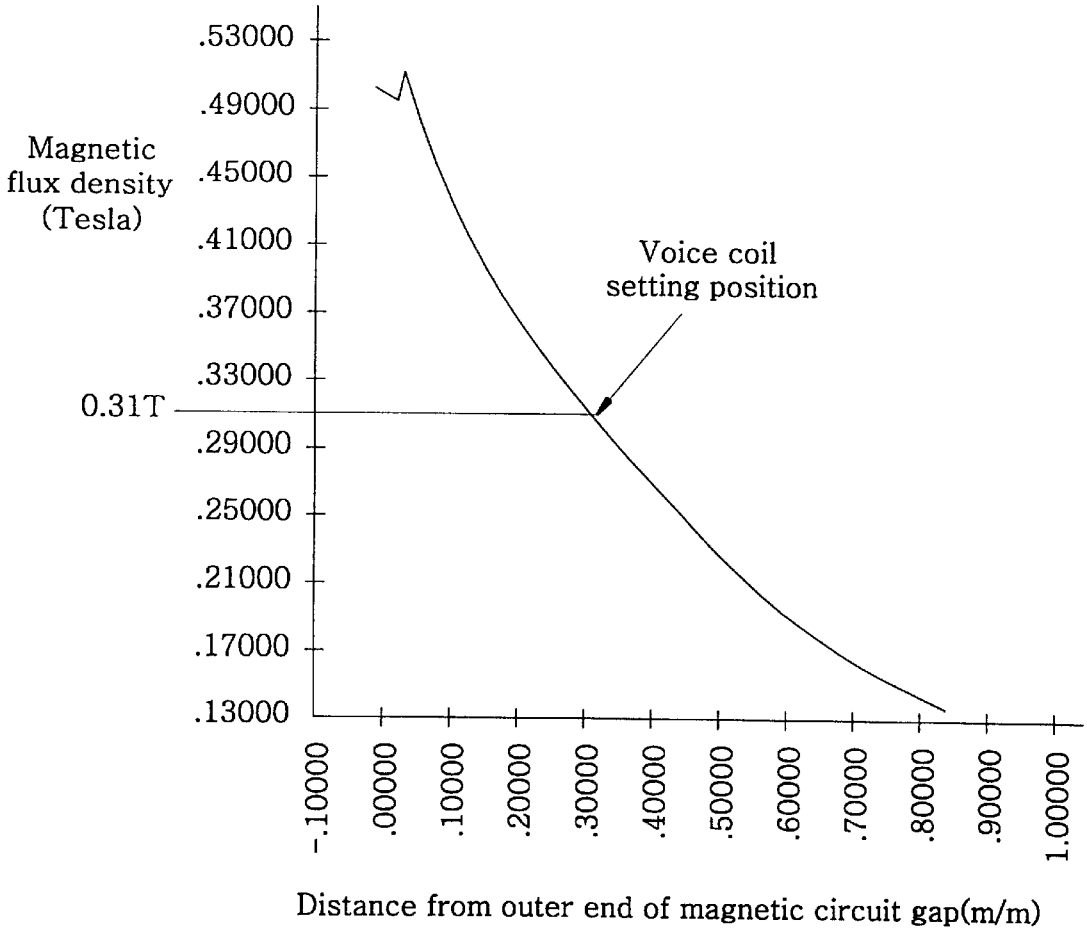
FIG. 7 is a graph illustrating a variation in magnetic flux density, depending upon an installation position of a vibrating coil in the speaker shown in FIG. 3.

Referring to FIGS. 6 and 7, there are shown graphs respectively illustrating variations in magnetic flux density, depending upon installation positions of the voice coil 24 and the vibrating coil 70 in the speaker 100 in accordance with the embodiment of the present invention.

As input values for results appearing on the graphs, each of the voice coil 24 and the vibrating coil 70 has a length of 1 m, applied current is 0.1 A, resistance of a lead wire is 10 Ω, and 1 V of an input voltage is used. As shown in FIGS. 6 and 7, at a selected position, magnetic flux density in the gap 80 and magnetic flux density outside the magnetic circuit section 40 were respectively 0.52 and 0.31 Tesla.

Here, since electromagnetic force, that is, force F which is applied to a lead wire when current flows through the lead wire which is placed perpendicularly to a direction of a magnetic field, is proportional to the magnetic field (magnetic flux density) B, the current I and a length L of the lead wire placed in the magnetic field, an equation $F=BIL$ can be established. Calculating electromagnetic force by using this equation, which is respectively applied to the voice coil 24 and the vibrating coil 70, electromagnetic force F1 which is applied to the voice coil 24, is 0.052 N ($F1=0.52\times0.1\times1$), and electromagnetic force F2 which is applied to the vibrating coil 70, is 0.031 N ($F2=0.31\times0.1\times1$). As a consequence, in the case of the aforementioned conventional speaker which exclusively employs only the voice coil 24, driving force for generating vibration, of 0.052 N, is obtained. However, in the case that vibrating coil 70 is connected in parallel with the voice coil 24 as in the present invention, driving force of 0.083 N is obtained by summing the two electromagnetic forces 0.052 N and 0.031 N, whereby driving force can be increased up to about 60%.

Hereinafter, operations of the speaker 100 in accordance with the embodiment of the present invention, constructed as mentioned above, will be described.

First, since the annular magnet 44 comprises a permanent magnet, magnetic fields as shown in FIG. 5 are formed in the gap 80 of the magnetic circuit section 40 and outside the magnetic circuit section 40, respectively.

In this situation, if an alternate signal which belongs to a radio frequency band, is applied to the voice coil 24 and the vibrating coil 70, electric field variations occur in the voice coil 24 and the vibrating coil 70, and thereby electromagnetic forces as described above are applied to the coils 24 and 70. At this time, by the fact that the voice coil 24 is integrally coupled to the vibrating plate 22, the electromagnetic force which is applied to the voice coil 24, vibrates the vibrating plate 22, whereby desired voice or sound is generated.

In this status, since the vibrating coil 70 is securely supported by the pair of supporting brackets 54, the electromagnetic force which is applied to the vibrating coil 70, acts on the entire magnetic circuit section 40. However, due to the fact that the entire magnetic circuit section 40 has a relatively large mass and the leaf spring 30 which supports the magnetic circuit section 40, has a relatively small spring constant, the entire magnetic circuit section 40 has a low resonance frequency and accordingly, vibration of the magnetic circuit section 40 does not occur. Therefore, in the case that an alternate signal of a frequency which is no less than a predetermined frequency belonging to a radio frequency band, is applied to the voice coil 24 and the vibrating coil 70, only the vibrating plate 22 is vibrated, whereby only voice or sound is generated. In this case, the electromagnetic force applied to the vibrating coil 70 indirectly imposes an influence on the vibrating plate 22 in such a way as to increase driving force which is used for generating voice or sound.

On the contrary, in the case that an alternate signal of a frequency which is less than the predetermined frequency belonging to a radio frequency band, is applied to the voice coil 24 and the vibrating coil 70, due to a relatively low resonance frequency of the entire magnetic circuit section 40, the electromagnetic forces which are applied to the voice coil 24 and the vibrating coil 70, vibrate the magnetic circuit section 40. The vibration is transmitted through the leaf spring 30 to the cylindrical frame 50. Thus, the entire speaker 100, that is, a portable phone or a beeper is vibrated. In the meanwhile, even though the vibrating plate 22 is vibrated by the electromagnetic force which is applied to the voice coil 24, because a vibration frequency in this case is less than an audible frequency, voice or sound is not generated at all.

As a result, the speaker capable of generating sound and vibration, according to the present invention, provides advantages in that sound or vibration is generated by interaction between a magnetic field developed in a magnetic circuit section and electric fields respectively developed in a voice coil and a vibrating coil. Further, since a sound generating function or a vibration generating function is automatically selected relying upon a frequency band of an applied signal, a separate device for converting one function to the other function is not required, whereby miniaturization and lightweightness of the entire speaker can be ensured. In addition, since the speaker uses leakage flux distributed on an outer part of the magnetic circuit section, driving force for generating sound and vibration can be remarkably increased.

Therefore, it is to be readily understood that the present invention provides a speaker which has a single device capable of generating sound and vibration when a radio incoming call is received in a communication terminal such as a portable phone, a beeper or the like, and uses a magnetic field leaking from an outer part of a magnetic circuit section, in a manner such that sufficiently powerful sound and vibration are obtained.

While it was described that the speaker according to the present invention is applied to a communication terminal such as a portable phone, a beeper, and so forth, a person skilled in the art will recognize that the idea of the present invention is not limited to the communication terminal, and instead, can be applied to other implements or instruments such as a headphone, etc., in which sound and vibration are generated using a single device.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A speaker having a device capable of generating sound and vibration for notifying reception of an incoming call when a radio incoming signal is received, the speaker comprising:

a cylindrical frame;

a magnetic field forming means disposed in the cylindrical frame for forming first and second magnetic flux;

wherein the magnetic field forming means includes an annular plate, an annular magnet and a yoke, the yoke having an annular flange portion, a cylindrical side wall portion extending upward from a circumferential inner surface of the annular flange portion and a top disc portion which closes an upper end of the cylindrical side wall portion, wherein the annular magnet and the annular plate are sequentially stacked on the annular flange portion of the yoke in a manner such that the cylindrical side wall portion and the top disc portion of the yoke are inserted into openings which are defined at center portions of the annular magnet and plate and a gap is defined between circumferential inner surfaces of the annular magnet and plate and a circumferential outer surface of the cylindrical side wall portion of the yoke, and the first magnetic flux is formed in the gap and the second magnetic flux is formed outside the annular magnet and plate, a sound generating section for producing electromagnetic force by interaction with the first magnetic flux and thereby generating sound, when a signal having a frequency which is no less than a predetermined frequency, is applied thereto, wherein the sound generating section includes a vibrating plate and a voice coil, wherein the voice coil is integrally coupled to a lower end of the vibrating plate and is located in the gap, and, when the signal having the frequency which is no less than the predetermined frequency, is applied to the voice coil, the voice coil interacts with the first magnetic flux, and thereby vibrates the vibrating plate and generates sound; and a vibration generating means for producing electromagnetic force by interaction with the second magnetic flux and thereby generating vibration, when a signal having a frequency which is less than the predetermined frequency, is applied thereto, wherein the vibration generating means includes a vibrating coil which is located between a circumferential inner surface of the cylindrical frame and the annular magnet, and a leaf spring which is coupled at one end thereof to a lower surface of the annular flange portion of the yoke to elastically support the yoke and is secured at the other end thereof to the cylindrical frame, wherein the vibrating coil is fixedly supported by the cylindrical frame, and, when the signal having the frequency which is less than the predetermined frequency, is applied to the vibrating coil, the vibration coil interacts with the second magnetic flux and thereby vibrates the magnetic field forming means.

2. The speaker as claimed in claim 1, wherein the vibrating coil is connected in parallel with the voice coil.

3. The speaker as claimed in claim 1, wherein the vibrating coil is connected in series with the voice coil.

* * * * *